US007594879B2

(12) United States Patent
Johnson

(10) Patent No.: US 7,594,879 B2
(45) **Date of Patent: *Sep. 29, 2009**

(54) ROTARY REHABILITATION APPARATUS AND METHOD

(75) Inventor: Kenneth W. Johnson, Pittsburg, KS (US)

(73) Assignee: Brainchild LLC, Pittsburgh, PA (US)

( * ) Notice: Subject to any disclaimer, the term of this patent is extended or adjusted under 35 U.S.C. 154(b) by 759 days.

This patent is subject to a terminal disclaimer.

(21) Appl. No.: 10/996,260

(22) Filed: Nov. 23, 2004

(65) Prior Publication Data

US 2005/0085353 A1 Apr. 21, 2005

Related U.S. Application Data

(63) Continuation-in-part of application No. 10/687,207, filed on Oct. 16, 2003, now Pat. No. 7,226,394.

(51) Int. Cl.
*A63B 22/06* (2006.01)

(52) U.S. Cl. ..... 482/57; 74/594.3

(58) Field of Classification Search ..... 482/57, 482/63, 110; 74/594.1, 594.3, 594.4, 594.7
See application file for complete search history.

(56) References Cited

U.S. PATENT DOCUMENTS

| | | | | |
|---|---|---|---|---|
| 4,509,742 | A * | 4/1985 | Cones | 482/58 |
| 4,611,807 | A * | 9/1986 | Castillo | 482/119 |
| 5,247,853 | A * | 9/1993 | Dalebout | 74/574.2 |
| 5,316,532 | A * | 5/1994 | Butler | 482/111 |
| 6,543,309 | B2 * | 4/2003 | Heim | 74/594.6 |
| 6,589,139 | B1 * | 7/2003 | Butterworth | 482/57 |

* cited by examiner

*Primary Examiner*—Loan H Thanh
*Assistant Examiner*—Tam Nguyen
(74) *Attorney, Agent, or Firm*—Lathrop & Gage LLP

(57) ABSTRACT

A rotary rehabilitation apparatus is presented for rehabilitation of a person's extremity, including the joints and assorted muscles, tendons, ligaments, that can be tailored to the person's needs based upon their physical size, type of injury, and plan for recovery. The apparatus facilitates the adjustment of the range of motion of the user's extremity in a cycling action by offsetting a moveable lever from a fixed lever at a plurality of angles. As the user's extremity moves in a circular path, the extremity engages in extension and flexion to cause movements in the articulations formed at the user's joints.

9 Claims, 12 Drawing Sheets

ROTARY REHABILITATION APPARATUS AND METHOD

RELATED APPLICATIONS

This application is a continuation-in-part application of U.S. patent application Ser. No. 10/687,207, filed Oct. 16, 2003 now U.S. Pat. No. 7,226,394. The aforementioned application is incorporated herein by reference.

BACKGROUND OF THE INVENTION

1. Field of the Invention

This invention relates generally to the field of exercise and rehabilitation, and more specifically, to an apparatus providing selective adjustment of the range of motion of a user's extremities, including either arms and legs, actively engaging in or passively participating in a cycling action.

2. Description of the Related Art

One of the most significant and the most common athletic injuries is to the knee, and published data continues to report at an incidence of between one-quarter and one-third of all men and women experience some type of knee injury annually. Approximately 10.8 million individuals visit a physician for knee injuries alone each year. Total estimated annual U.S. costs of all musculoskeletal conditions is $254 billion. Many injuries to the lower extremities of persons necessitate the use of rehabilitation exercises. Such injuries may include those to the joints of a person's leg (e.g., knee, hip ), replacement of one's joint (e.g., total hip or knee arthroplasty [THA, TKA]), ligaments or tendons associated with these joints (e.g., anterior cruciate or medial collateral ligament [ACL, MCL], or patella or quadriceps tendons), or muscles of the leg (e.g., Rectos or biceps femoris, etc). Rehabilitation exercises are also frequently prescribed after surgery and are performed to further repair an injured site on a user's extremity.

Major trunk injuries are also exceedingly common in the United States. Major trunk injuries include those injuries that affect the shoulders and back. The shoulder joint, being the most flexible joint in the human body, can be easily injured because of accidentally over-extending the range of motion. The U.S. Department of Labor estimates that thirty-five percent of all muscoskeletal injuries are major trunk injuries. Over four million visits are made to health care professionals each year because of shoulder injuries. Moreover, the U.S. Department of Labor estimates that the average time off-work for shoulder injuries is twelve days. This corresponds to an estimated $13-20 billion due to time lost from work.

One common rehabilitation exercise recommended to improve muscle, ligament and tendon strength, and endurance for extremities post-injury or post-surgically, is movement in a cycling motion. The movement of a person's upper or lower extremity in a circular path induces motion in the articulations that form the shoulder and elbow or hip and knee, respectively. However, for rehabilitation to be effective, it must be tailored to the specific needs of a given person based on their physical size, type of injury, and plan for recovery, among other factors. For example, if a surgical repair has been made to a torn ACL of a person's leg, it is often desirable at the beginning of a rehabilitation regimen to limit the flexion or extension of the knee, due not only to pain, but also to avoid damage to the repair. Likewise, for the shoulder, a physician may recommend limiting the motion of the shoulder to something far less than its full capability of 360 degrees until natural recovery and sufficient rehabilitation has occurred. Although cycle-type exercise machines are recommended for use in certain rehabilitation regimens, they generally do not facilitate the adjustment of the range of motion of one individual extremity. Further, these machines are limited to the standard pedal or handle arrangement where one lever (handle or pedal) is offset from the other by 180 degrees around a hub. There are, however, rehabilitation regimens where benefits to flexibility, strength, and/or endurance are achieved by offsetting levers or handles at another angles for passive, assisted active, and active range of motion.

SUMMARY OF THE INVENTION

A rotary rehabilitation apparatus is presented that allows for the selection of a range of motion for upper and/or lower extremities of a person engaging in a cycling action. The adjustable lever assembly allows for safer, more immediate rehabilitation following hip, knee, shoulder, and/or elbow injuries and further provides for pain reduction, increasing the range of motion, strengthening soft tissue and general conditioning. The assembly comprises one movable lever and a flywheel rotatably mounted on a support and having a series of bores along a diameter thereof with which the movable lever or handle is releasably mounted. In an exemplary arrangement where the rotary rehabilitation apparatus is incorporated with a cycle-type exercise machine, for example a cycle ergometer, a user will sit on the seat and place their feet or hands on the levers to impart a force thereon. As the user's feet or hands move in a circular path, the extremities engage in extension and flexion to cause movement in the articulations formed at the user's hip and knee or shoulder and elbow joints. The amount of movement in the articulations of the extremity and consequently, the range of motion at these joints can be controlled by mounting the lever with the appropriate bore on the flywheel. If increased extension and flexion is desired, the lever can be mounted with a bore further away from the axis of rotation of the flywheel. Conversely, if a smaller degree of extension and flexion is preferred, the lever can be mounted with a bore closer to the flywheel axis of rotation.

In one configuration, the moveable lever is releasably mounted within a mounting bore of the flywheel and the other lever is left at full diameter. This configuration allows an adjustable range of motion for one extremity and a fixed range of motion for the other extremity, which allows for more limited, rehabilitative exercises for one extremity (e.g., an injured knee or shoulder) and more robust exercises for the other.

In another aspect, more than one series of bores extend across different diameters of the flywheel, so that the movable lever can be mounted at various angles with respect to the fixed lever around the axis of rotation. For example, while levers are typically aligned 180 degrees from one another around a hub on an cycle-type exercise machine, it may be desired in rehabilitation regimens to position the levers at a different angle to work on the passive range of motion ("PROM"), the assisted active range of motion ("AAROM"), and the active range of motion ("AROM").

The rotary rehabilitation apparatus of the present invention provides improved options for rehabilitation regimes where a cycling or rotary action would be beneficial to recovery from injury of a person's extremities. As a user progresses in their injury recovery, such as by increasing strength and flexibility in their extremities, the movable lever or handle can be disengaged and remounted within another bore that provides a different range of motion for their extremity when rotating the assembly.

By rapidly affecting PROM, AAROM and AROM this invention will reduce the time required to recover from extremity injuries, increasing improvements in measurable outcomes such as range of motion, edema, proprioception, return to unassisted gait activities, initial functional independent measures, strength and conditioning; reduce overall inpatient and outpatient costs, accelerate return to vocational or avocational activities; and significantly improve quality of life by expediting a return to autonomy.

DETAILED DESCRIPTION OF THE INVENTION

Figure 2:
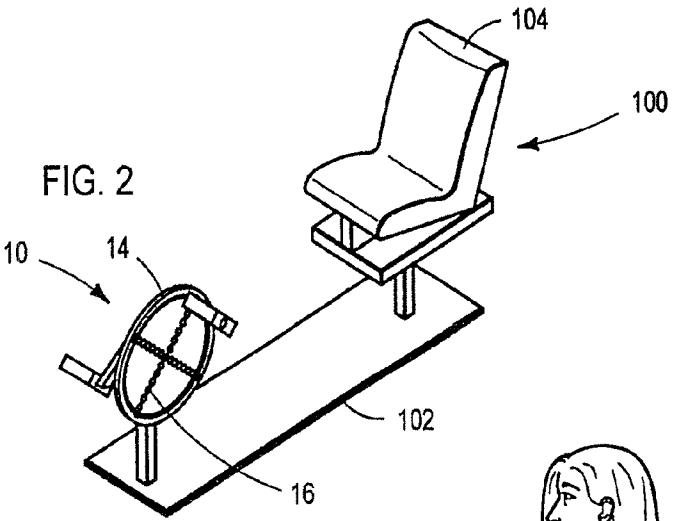
FIG. 2 is perspective view of the rotary rehabilitation apparatus of the present invention incorporated with a cycle-type exercise machine.
Figure 1:
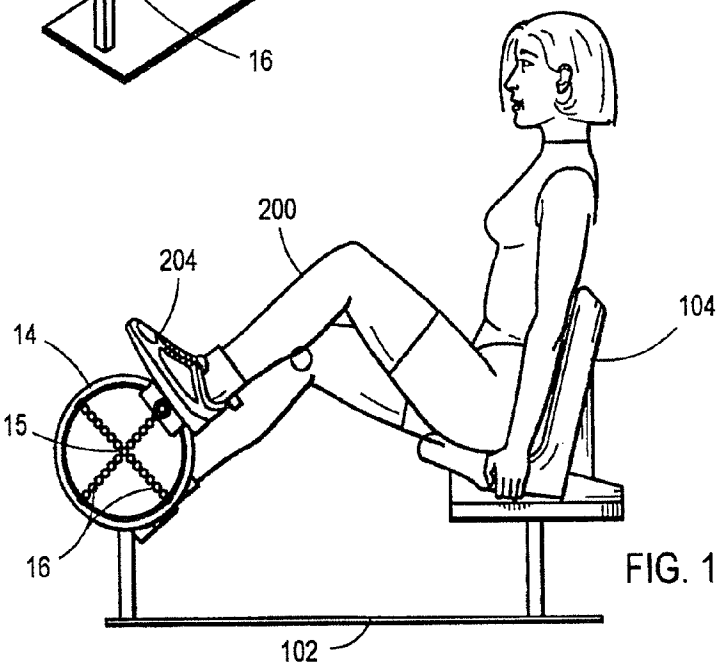
FIG. 1 is a right side elevation view of the rotary rehabilitation apparatus of the present invention incorporated with a cycle-type exercise machine.
Figure 3:
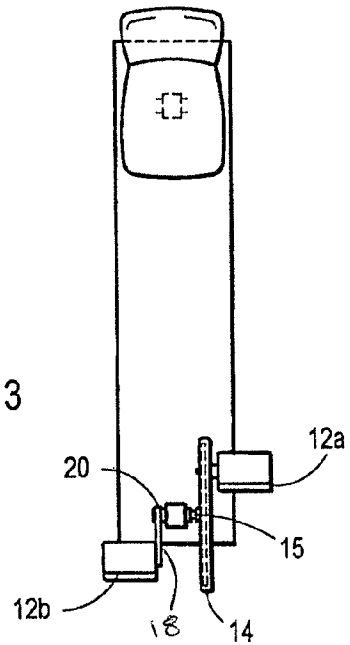
FIG. 3 is a top plan view of the rotary rehabilitation apparatus of the present invention incorporated with a cycle-type exercise machine.
Figure 4:
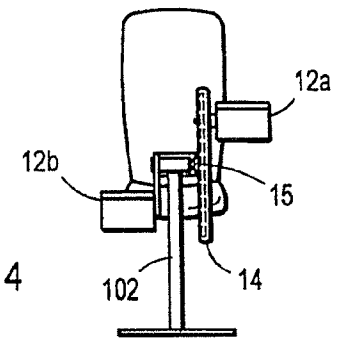
FIG. 4 is a front elevation view of the rotary rehabilitation apparatus of the present invention incorporated with a cycle-type exercise machine.

One rotary rehabilitation apparatus 10 providing for the selection of a range of motion for one or both legs 200 of a person is shown in FIGS. 1-4. An embodiment of the rotary rehabilitation apparatus for rehabilitating a person's upper extremities will be discussed in detail below. The rotary rehabilitation apparatus 10 is shown incorporated in a cycle-type exercise machine 100 having a support 102 upon which the apparatus 10 is rotatably mounted and a seat 104 positioned at a distance from the support 102. In this arrangement, the person can sit in the seat 104, place their feet 204 on the levers 12*a* and 12*b* and impart a pushing force thereto with their legs 200 to rotate a flywheel 14 at a center point 15 thereof around an axis extending in the horizontal plane.

The adjustable range of motion for each leg 200 is achieved by having the movable lever 12*a* be repositionable along one or more diameters of the flywheel 14. The flywheel 14 has a series of bores 16 extending laterally there through parallel to the flywheel rotational axis and formed in a row along the flywheel diameter so that the lever 12*a* can be removably mounted with one of the bores 16. In the embodiment of the rotary rehabilitation apparatus 10 shown in FIGS. 1-4, the flywheel 14 has two separate series of bores 16 each aligned along one flywheel diameter and orthogonal to one another.

Figure 5:
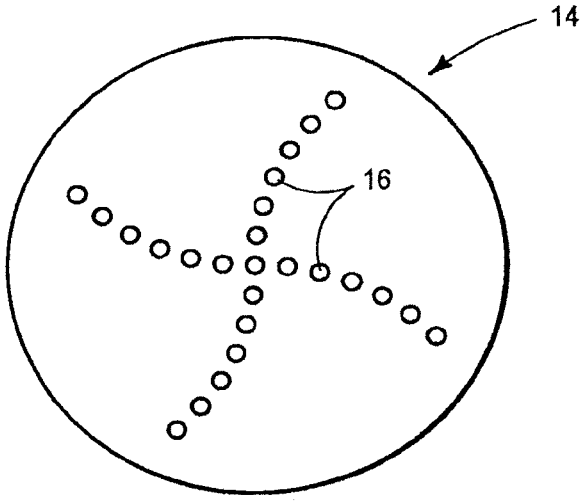
FIG. 5 is a side elevation view of an embodiment of the flywheel with a non-linear configuration of bore holes.
Figure 6:
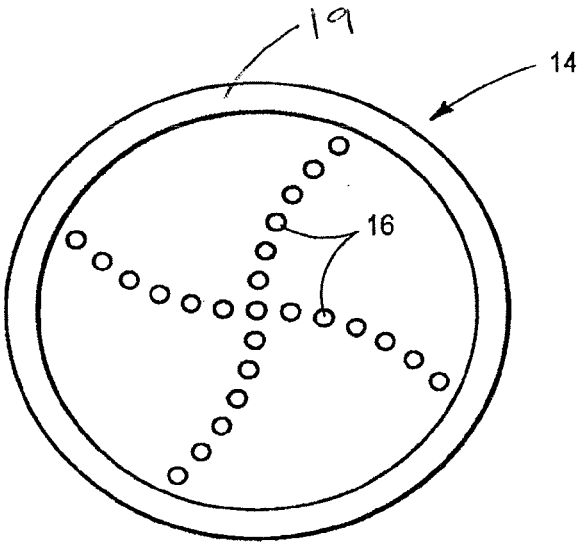
FIG. 6 is a side elevation view of an embodiment of the flywheel with a non-linear configuration of bore holes with a continuous ring of additional mass applied to the outer perimeter of the flywheel to increase the flywheel inertia.
Figure 7:
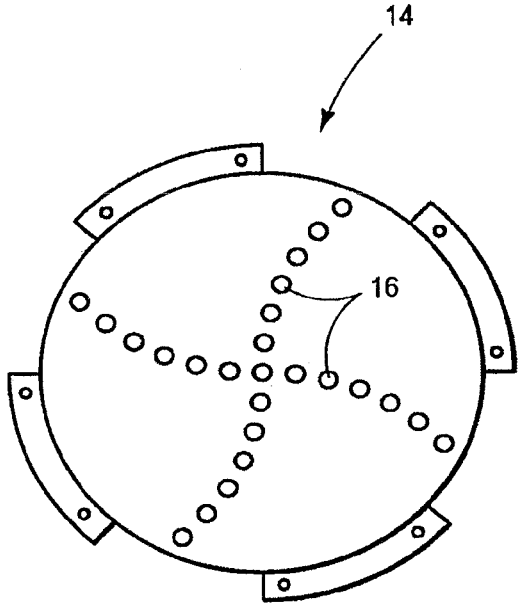
FIG. 7 is a side elevation view of an embodiment of the flywheel with a non-linear configuration of bore holes with a non-continuous ring of additional mass applied to the outer perimeter of the flywheel to increase the flywheel inertia.
Figure 8:
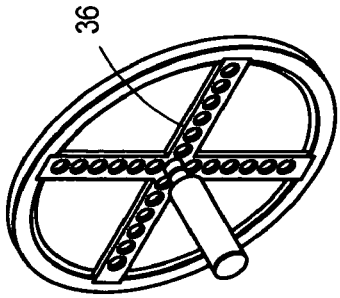
FIG. 8 is a left perspective view of the flywheel with a linear configuration of bore holes mounted with the hub.
Figure 9:
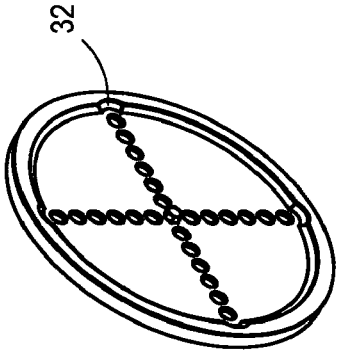
FIG. 9 is a right perspective view of the flywheel of FIG. 8.
Figure 12:
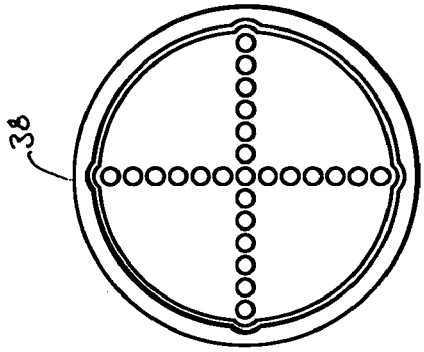
FIG. 12 is a right side elevation view of the flywheel of FIG. 8.

FIGS. 5-7 show an embodiment of the flywheel 14 that utilizes a non-linear configuration of two series of bores. This non-linear configuration provides separate options for ranges of motion and can be highly beneficial with certain patients who have experienced difficulty in achieving improvements with their range of motion utilizing the linearly arranged bore holes. FIG. 6 reveals an embodiment of the flywheel 14 that utilizes a continuous ring 19 at the outer perimeter wall of the flywheel. FIG. 7 conversely utilizes a non-continuous outer ring 17. Both embodiments include additional mass at the outer ring of the flywheel 14 to increase the inertia of the flywheel and enhance the benefits associated with passive rotation. By increasing the mass of the flywheel at the perimeter wall of the flywheel, the desired rotation speed can be maintained with reduced energy input from the extremity of the user.

As can also be seen in FIGS. 1-4, the movable lever 12*a* is mounted with the flywheel 14 and the fixed lever 12*b* is mounted with a crank 18 extending radially from a hub 20 with which the flywheel 14 is rotatably mounted at the center point 15. This configuration allows for lever adjustment both along the flywheel 14 diameter towards or away from the center point 15, and concentrically on the flywheel 14 around the center point 15 such that the lever 12*a* may be at an offset angle relative to the fixed lever 12*b* about the flywheel axis of rotation of 90, 180 or 270 degrees.

FIGS. 8-12 show more detail of the flywheel 14 and mounting with the hub 20. The flywheel 14 comprises a circular disk 22 having opposing first and second planar surfaces 24, 26 and a perimeter wall 28, and a circumferential ring 30 fixed around the perimeter wall 28. The ring 30 may be press fit onto the disk perimeter wall 28 or may be mounted thereto with fasteners or adhesives. A first set of notches 32 are formed along an inner edge 34 of the ring 30 adjacent to the disk first planar surface 24 and in alignment with each row of the series of bores 16. These notches 32 facilitate the extension of brace members 36 across the disk planar surface 26 on a diameter of the ring 30 to matingly fit with the notches 32. A second set of notches 38 having a curved profile are formed along the ring inner edge 34 adjacent to the disk second planar surface 26. When the movable lever 12*a* is mounted with the bore 16 furthest from the center point 15, the notches 38 provide extra clearance such that the lever 12 fits properly adjacent to the second planar surface 26.

Depending on the functionality desired in the cycle-type exercise machine 100, the flywheel 14 can be designed to have a relatively large or small moment of inertia. A large moment of inertia flywheel 14 requires more peddling force to accelerate the same to a given speed, but also causes the flywheel 14 to better resist changes in speed, resulting in smoother "steady-state" cycling, which may be preferred in certain rehabilitation exercises. The higher moment of inertia is created by making the flywheel 14 heavier and/or moving more of the flywheel weight out to the circumferential ring 30.

The flywheel 14 is mounted with the hub 20 by insertion of a fastener 39 through the bore 16 of the disk 22 forming the center point 15 of the flywheel 14 and through a coupling 40 for securing with the hub 20. Specifically, the fastener 39 extends into a receiving bore 42 formed in a stem 44 rotatably mounted within a body 46 of the hub 20. In this arrangement, the hub body 46 is stationary on the support 102 while the hub stem and the mounted flywheel 14 rotate relative to the hub body 46. The hub 20 is preferably mounted adjacent to the first planar surface 24 on a side of the flywheel 14 opposite of the movable lever 12*a*.

In addition to controlling the moment of inertia in the flywheel 14, the overall resistance to turning of the flywheel 14 may be controlled to increase the amount of work a user must perform in peddling, as those of skill in the art appreciate with respect to known cycle-type exercise machines. For example, frictional resistance may be incorporated in to the design of the hub 20, such that the rotation of the stem 44 relative to the hub body 46 requires a certain amount of force to overcome the static and dynamic friction within the hub 20. Alternatively, a frictional surface (not shown), for example, a brake, may selectively engage the circumferential ring 30 to create static and dynamic friction.

Figure 15:
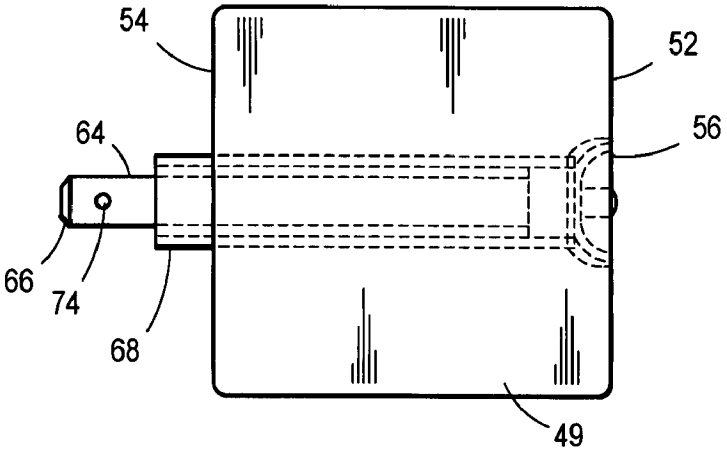
FIG. 15 is a top plan view of an embodiment of a pedal lever assembly.
Figure 16:
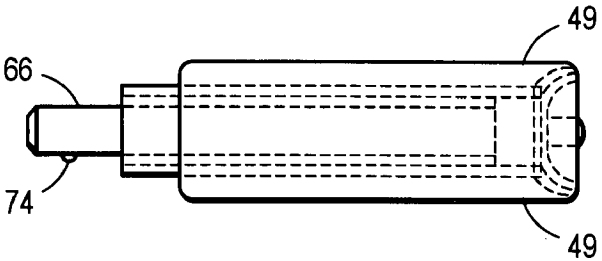
FIG. 16 is a left side elevation view of an embodiment of a pedal lever assembly.

FIGS. 13-17 show the components of the movable lever 12*a*. The lever body 48 has opposing surfaces 49 onto which the user's foot is placed and a bore 50 extending through the body 48 from a lateral side face 52 to a medial side face 54. A chamfer 56 is also formed at the bore entrance of the lateral side face 52. A sleeve 58 has a first end 60 and a second end 62, and is configured for insertion into the bore 50 such that the second end 62 extends out of the lever medial side face 54 as shown in FIG. 15. A pin 64 is inserted into the sleeve 58 and has a shank 66 extending out of second end 62 thereof, and a collar 68 having a concentric base 70 configured to abut the first end 60 and a beveled region 72 mateably fitting within the chamfer 56. A protrusion 74 is formed on the shank 66 near an end distal to the collar 68 such that the pin 64 frictionally fits within one bore 16 of the flywheel 14 to secure the lever body 48 thereto. If enough of a pulling force is applied to the lever body 48 away from the flywheel 14, the protrusion 74 is removed from the frictional fit in the bore 16 and may be repositioned as desired in another bore 16. The lever body 48 and sleeve 58 are also rotatable about the pin 64 such that as the flywheel 14 rotates, one of the peddling surfaces 49 is maintained in alignment such that the user can continue to apply a force thereto with their feet 204 through the cycling motion.

Figure 18:
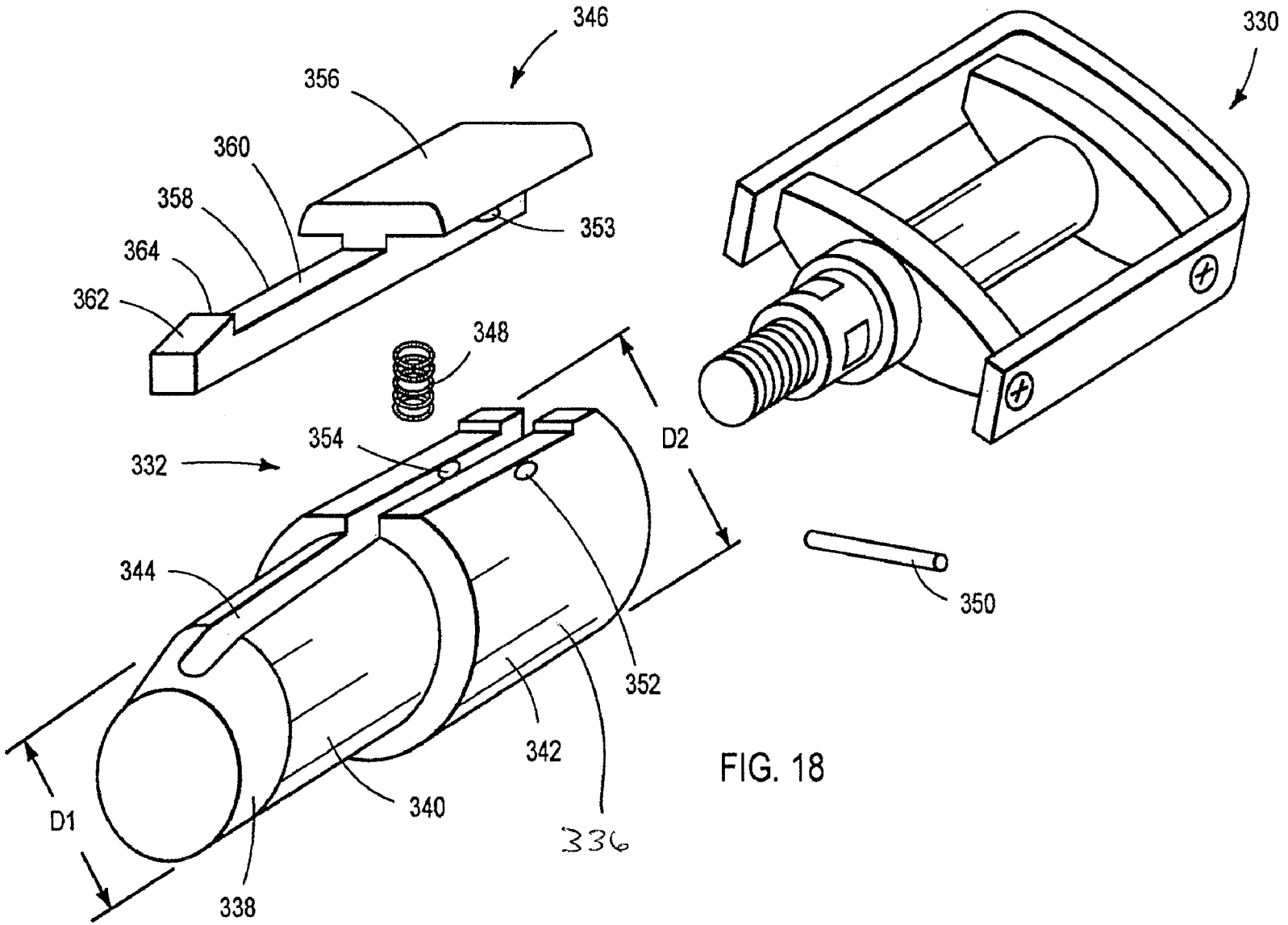
FIG. 18 is an exploded view of the slotted bushing including the locking lever and a standard bicycle pedal.

In an alternative embodiment as shown in FIG. 18, a standard bicycle pedal 330 can be employed with a quick release adaptor 332. The utilization of a standard bicycle pedal 330, a bicycle pedal with clips or a hand grip, with the quick release adaptor 332 is highly desirable in this application because if the pedal is damaged or simply wears out it can be quickly and inexpensively replaced by purchasing it at a wide array of commercial retail establishments. Moreover, it is critical in rehabilitation settings that the levers be easily removed and repositioned because many patients have reduced strength because of injuries or debilitating illnesses that limit the amount of force they can apply in these situations. While the application of a bicycle pedal in this invention is addressed in more detail below it should be understood that other apparatus for application of force from the extremities of a user are also contemplated. For example, hand grips for utilization by the hands of a user in-lieu of pedals for the feet are also contemplated by this invention.

In FIG. 18 a standard bicycle pedal 330 is shown approaching engagement with the quick release adaptor 332. In this embodiment, the combination of a pedal and the quick release adaptor is defined as a lever. The quick release adaptor 332 is comprised of a machined bushing 336 with a beveled edge 338, a first shaft 340 of diameter D1 and a second shaft 342 of diameter D2. A slot 344 is machined into the bushing 336 wherein a spring loaded locking lever 346 resides. The portion of the locking lever 346 proximate the beveled edge 338 is biased upward away from the center of the shafts 340, 342 through the force of a spring 348. The locking lever 346 is held in position in the slot 344 with the assistance of a roll pin 350 that is inserted through holes 352, 354 in the second shaft 342 and through a hole 353 in the locking lever 346 itself. The roll pin 350 serves as a pivot point about which the locking lever 346 can rotate a sufficient amount to facilitate detachment of the quick release adaptor 332 from the flywheel 14.

Figure 19:
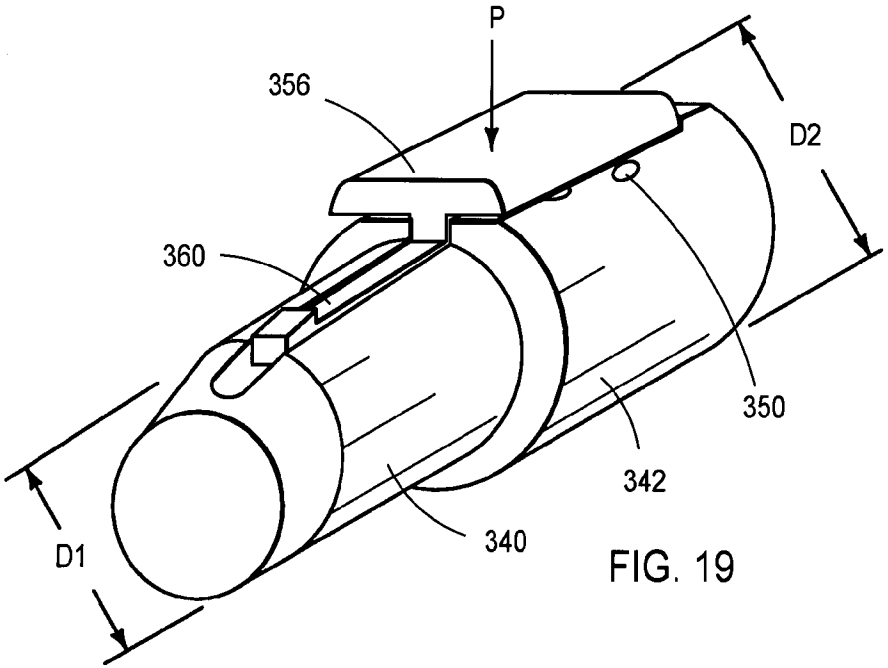
FIG. 19 is a perspective view of the slotted bushing with the locking lever in position.

As shown in FIG. 19, the locking lever 346, in its preferred embodiment, utilizes a push pad 356 wherein finger or hand pressure P is applied forward of the roll pin 350 to overcome the force of the spring 348 (not shown), which is also located forward of the roll pin and beneath the locking lever 346 in the slot 344. Pressure P rotates the locking lever 346 downward about the roll pin 350. As seen in FIG. 18 and extending from the push pad 356 is a locking lever shaft 358 such that when the locking lever 346 is positioned within the slot 344 the surface 360 of the locking lever shaft 358 is flush with, or slightly below, the outer diameter D1 of the first shaft 340. Maintaining the locking lever shaft 358 flush with the outer shaft diameter D1 allows the quick release adaptor 332 to be inserted into a bore 16 of the flywheel 14 without interference. As shown in FIG. 18 adjacent to the shaft 358, and opposite the push pad 356, is the locking pad 362. The locking pad 362 utilizes a locking face 364 that upon insertion into and once passing through the bore 16 secures the quick release adapter 332 in position and prevents inadvertent extraction of the quick release adapter 332. The upper surface 366 of the locking pad 364 is beveled at the same slope as the beveled edge 338 to further facilitate insertion of the quick release adapter 332 into position through the bore 16. Once the locking pad 362 is inserted entirely through the bore the spring 348 forces the entire locking pad 362 upward including the locking face 364.

Figure 21:
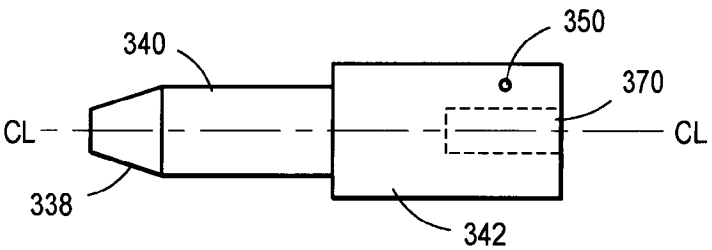
FIG. 21 is a side view of the slotted bushing with phantom threads for connecting to the pedal.

As shown in FIG. 21, second shaft 342 with diameter D2 includes internal threads 370 for installation of a standard bicycle pedal 330. The preferred threads are standard 9/16 inch with 20 threads per inch; however, it should be understood that other thread configurations are also contemplated.

Figure 22:
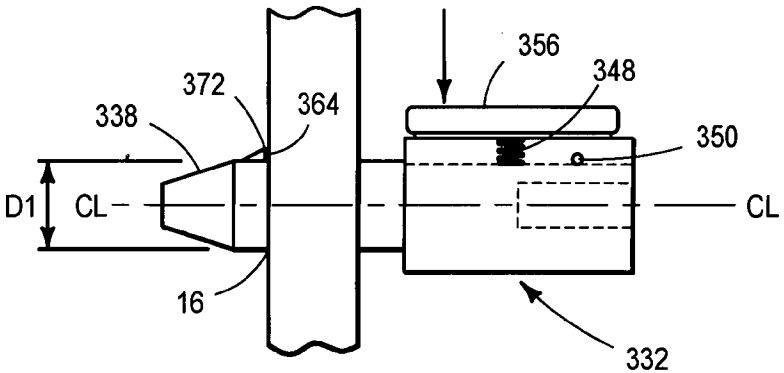
FIG. 22 is a side view of the quick release adaptor inserted through the flywheel with the locking face positioned against the planar surface of the flywheel.
Figure 20:
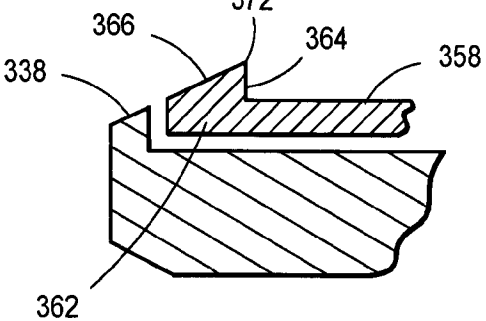
FIG. 20 is a sectional view of the beveled front of the slotted bushing including the locking pad and locking face.
Figure 24:
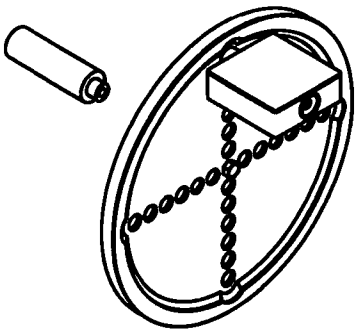
FIG. 24 is a right perspective view of the rotary rehabilitation apparatus showing the lever mounted with the flywheel and the hub with which the flywheel is mounted.
Figure 23:
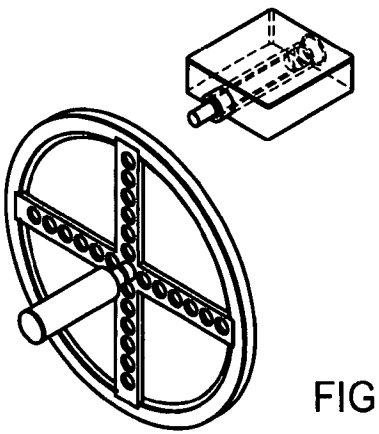
FIG. 23 is a left perspective view of the rotary rehabilitation apparatus showing one lever approaching engagement with one of the bores of the flywheel and the flywheel rotatably mounted with a hub.
Figure 27:
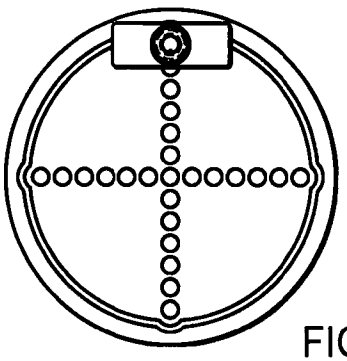
FIG. 27 is a right elevation view of the rotary rehabilitation apparatus of FIG. 25.
Figure 25:
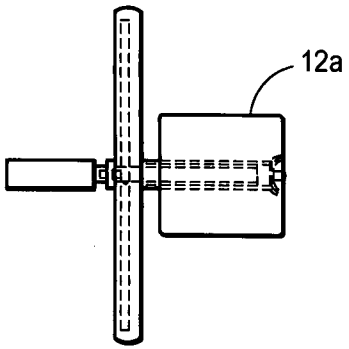
FIG. 25 is a top view of the rotary rehabilitation apparatus showing the lever mounted with the flywheel, and the flywheel mounted with the hub.
Figure 26:
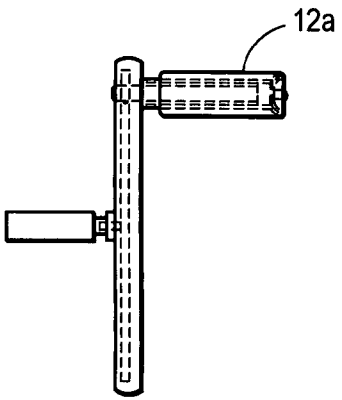
FIG. 26 is a front elevation view of the rotary rehabilitation apparatus of FIG. 25.

In operation, the bicycle pedal 330 is threaded into the internal threads 370 of the quick release adaptor 332. The user then inserts the end of the quick release adaptor 332 with the beveled edge 338 into the desired flywheel bore 16 to the point where the locking face 364 of the locking pad 362 reaches the opposite side of the flywheel 14. As shown in FIGS. 20 and 22 once the locking face 364 reaches the opposite side of the flywheel 14 the force of the spring 348 pushes the locking face 364 upward to a point where the tip 372 of the locking face 364, measured from the centerline CL of the shaft 340 exceeds the dimension D1. Once the tip 372 of the locking face 364 extends beyond D1 the quick release adaptor 332 cannot be withdrawn through the bore 16 without the tip 372 of the locking face being lowered to at least D1 because the tip 372 interferes with the opposite face of the flywheel 14 when attempting to withdraw the quick release adapted 332. In order to withdraw the quick release adaptor 332, the user must apply pressure P to the push pad 356 forward of the roll pin 350 thereby causing the locking lever 346 to rotate downward forward of the roll pin 350. Once the tip 372 of the locking face 364 is lowered to a point where it less than D1 from the centerline CL the entire assembly comprised of the quick release adaptor and the bicycle pedal 330 can be withdrawn from the bore 16 of the flywheel 14 and repositioned as desired by the user by repeating the steps outlined above.

Figure 29:
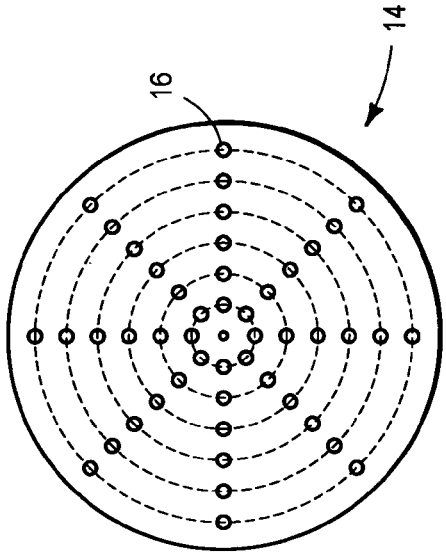
FIG. 29 is a side elevation view of another embodiment of the disk of the flywheel showing a linear configuration of bores along four diameters thereof.
Figure 28:
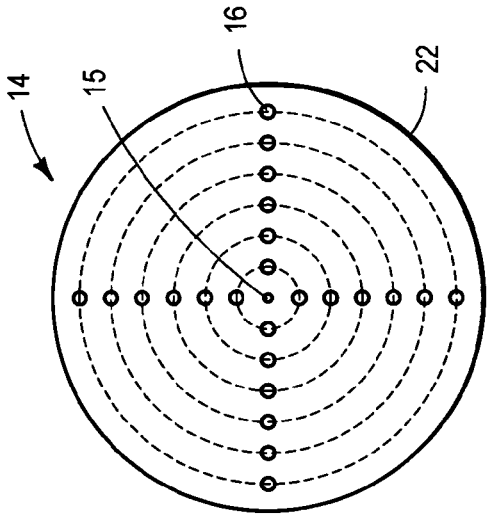
FIG. 28 is a side elevation view of one embodiment of the disk of the flywheel showing a linear configuration of bores along two diameters thereof.

FIGS. 23-27 show an exemplary orientation for the rotary rehabilitation apparatus 10 where the movable lever 12*a* is shown mounting with one of the radially outermost bores 16 of the flywheel 14. In FIG. 28, an embodiment of the flywheel 14 having two series of linear bores 16 is shown. Each concentric dotted line on the flywheel disk 22 connecting bores 16 on different rows represents a certain distance from the center point 15 (i.e., point of rotation) of then flywheel 14, for example, one inch. Thus, one can quickly determine the degree of adjustment achieved by mounting a movable lever 12*a* with one particular bore 16. FIG. 29 shows another flywheel 14 embodiment having four series of bores 16 with each row rotated 45 degrees with respect to one another. Other bore arrangements of 30 and 60 degrees, for example, are also contemplated as required by the needs of the user's extremities. This arrangement allows for more fine-tuning of the angle offset between the movable lever 12*a* and the fixed lever 12*b*, which may be desired in certain rehabilitation regimens.

Figure 10:
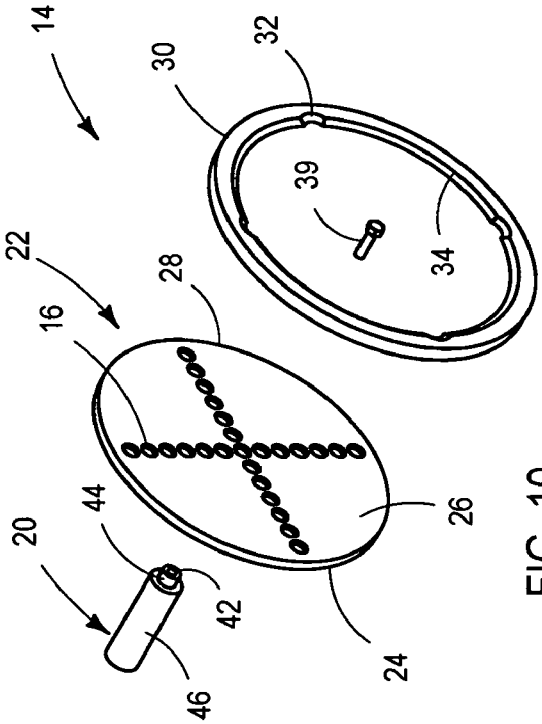
FIG. 10 is an exploded view of the flywheel as mounted with the hub.
Figure 11:
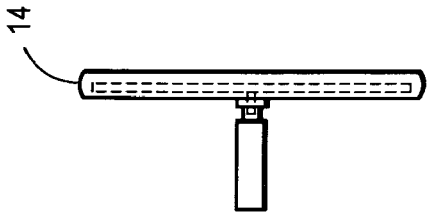
FIG. 11 is a front elevation view of the flywheel of FIG. 8.
Figure 13:
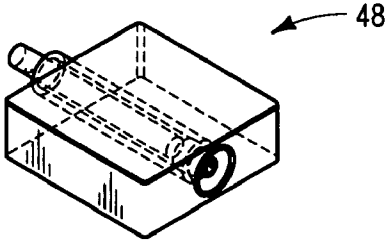
FIG. 13 is a perspective view of an embodiment of a pedal lever assembly.
Figure 14:
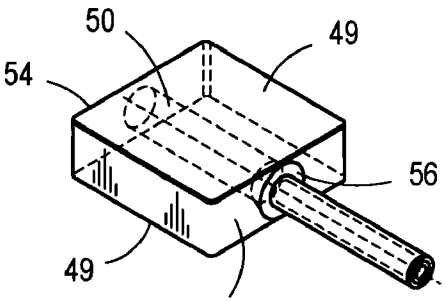
FIG. 14 is an exploded view of an embodiment of a pedal lever assembly.
Figure 14:
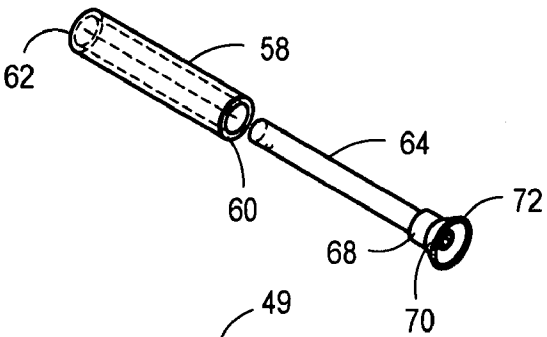
Figure 17:
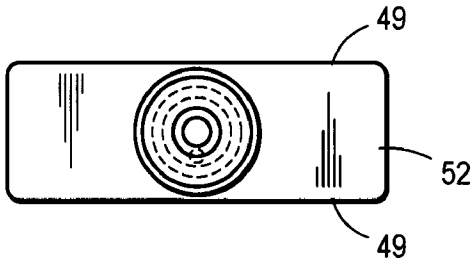
FIG. 17 is an front elevation view of an embodiment of a pedal lever assembly.
Figure 30:
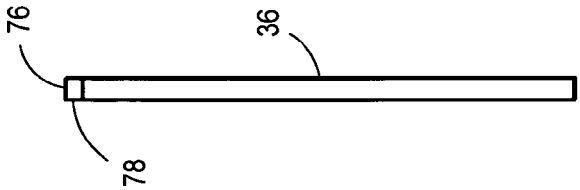
FIG. 30 is a side elevation view of one brace member of the flywheel.
Figure 31:
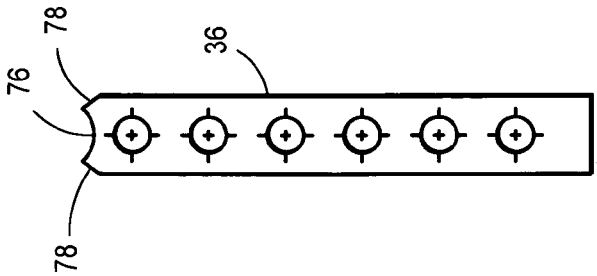
FIG. 31 is a front elevation view of the brace member of FIG. 30.
Figure 34:
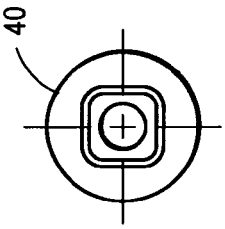
FIG. 34 is a front elevation view of the coupling of FIG. 32.
Figure 33:
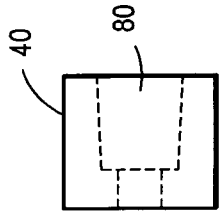
FIG. 33 is a side elevation view of the coupling of FIG. 32.
Figure 32:
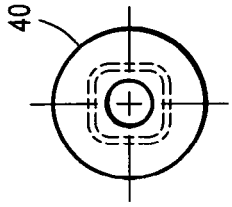
FIG. 32 is a rear elevation view of the coupling for mounting the hub with the flywheel.

FIGS. 30 and 31 show one brace member 36 having a curved edge 76 for abutting the coupling 40 on an end opposite of the notches 32 of the circumferential ring 30, and beveled edges 78 on either side of the curved edges 76. Each beveled edge 78 of one brace member 36 abuts a beveled edge 78 of another brace member 36 extending along an adjacent row of the series of bores 16. FIGS. 32-34 also show the coupler 40 in detail. A cavity 80 is formed in the cylindrical coupler 40 and is shaped to receive the stem 44 of the hub 20. Also as seen in FIG. 10 along with FIGS. 32-34, a bore extends from the cavity 80 through the coupler 40 with a length sufficient to allow the fastener 39 to extend there through to reach the stem 44. In this way, the coupler 40 provides the interface to more securely mount the flywheel 14 for rotation about the hub body 46.

Figure 36:
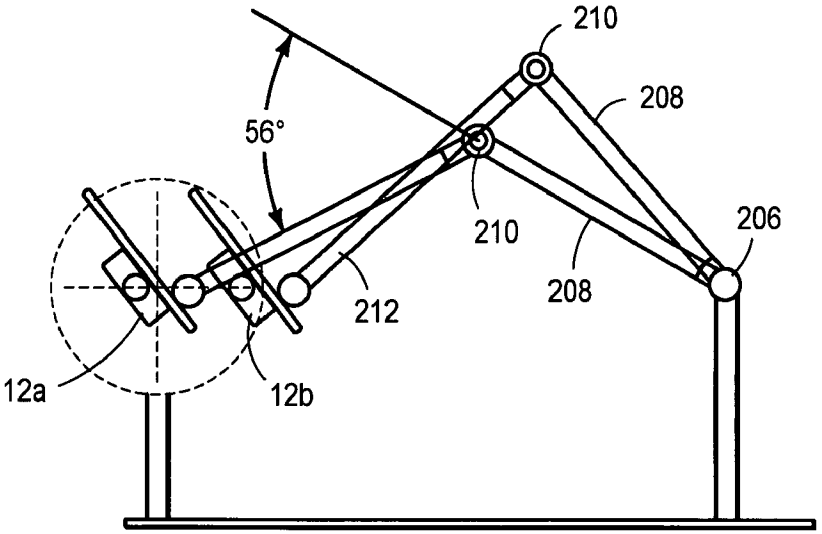
FIGS. 35 and 36 schematically show leg members having feet positioned on the levers of the rotary rehabilitation apparatus at a first position of rotation and at a second position of rotation.
Figure 35:
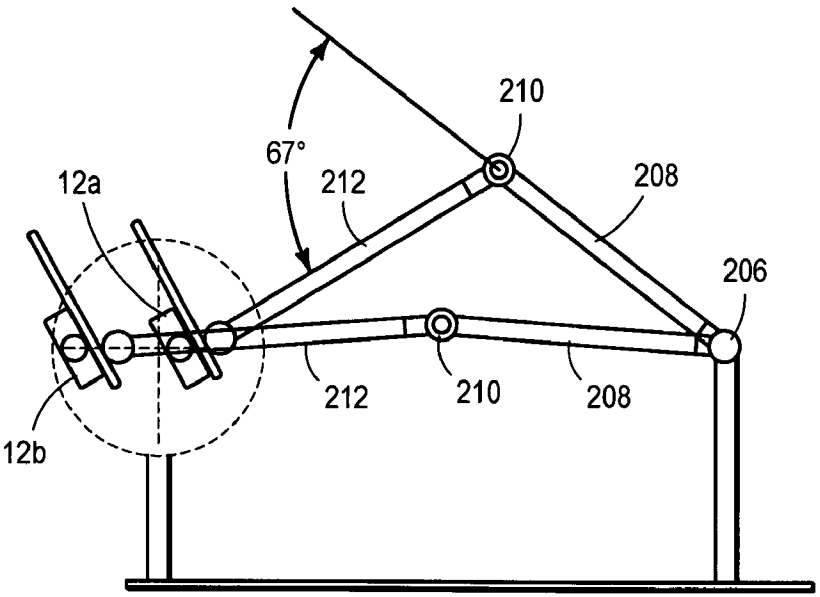

The motion of a person's legs 200 utilizing the rotary rehabilitation apparatus 10 of the present invention is simulated in FIGS. 35-36 showing the hip joint 206, the upper leg 208 (e.g., the femur), the knee joint 210 and the lower leg 212 (e.g., the tibia). In FIGS. 35 and 36, the fixed lever 12*b* is at a radial distance (e.g., 6 inches) from the flywheel 14 axis of rotation that is much greater that the radial distance of the movable lever 12*a* (e.g., 1 inch) from such axis of rotation. This provides a relatively large range of motion for the user's leg peddling the fixed lever 12*b* while providing a relatively small range of motion for the leg rotating the movable lever 12*a*. In this configuration, the movable lever 12*a* limits the change in angle formed between the lower leg 212 and a tangent extension of the upper leg 208 to 11 degrees, with the angles remaining between 67 degrees and 56 degrees.

Figure 38:
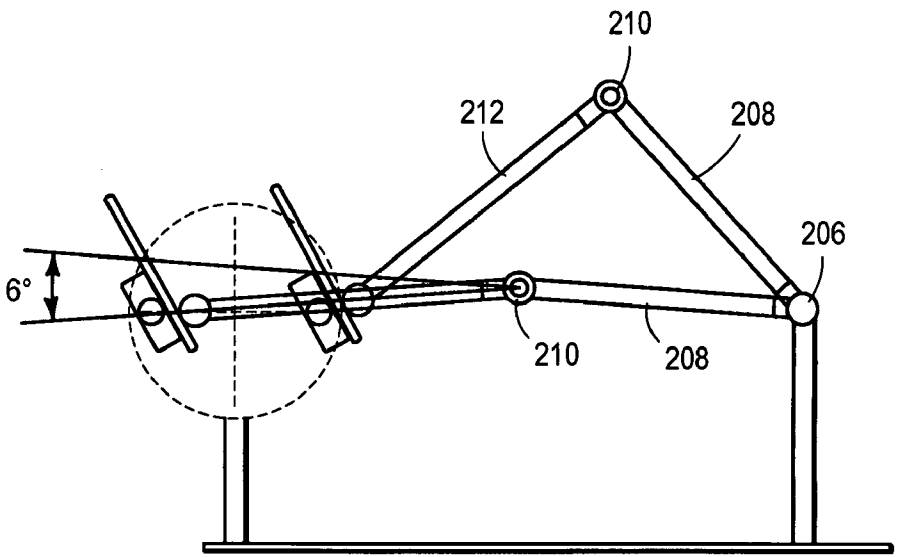
FIGS. 37 and 38 schematically show leg members having feet positioned on the levers of the rotary rehabilitation apparatus with one of the levers mounted at a different position on the flywheel than the levers of FIGS. 35 and 36 and the levers being at a first position of rotation and at a second position of rotation.
Figure 37:
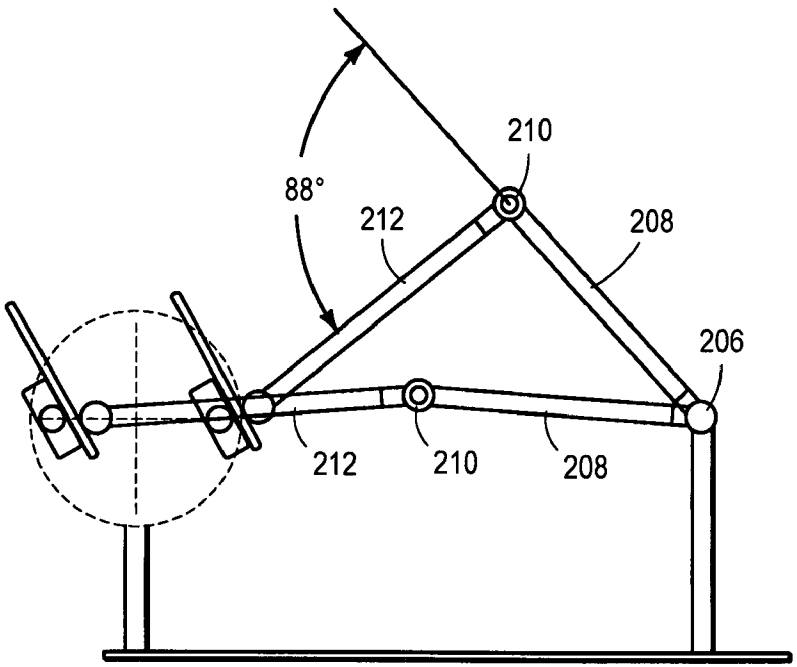

This rehabilitation regimen may be recommended when the user is not to bend their leg to a certain degree, for example, to limit stresses on the hip 206 or knee 210. Conversely, in FIGS. 37 and 38, the movable lever 12*a* and fixed lever 12*b* are at the same radial distance (e.g., 6 inches) from the flywheel 14 axis of rotation. Thus, both of the user's legs will participate in a large range of motion when peddling with the apparatus 10. The movable lever 12*a*, in the embodiment of FIGS. 37 and 38, allows for the angle formed between the lower leg 212 and a tangent extension of the upper leg 208 to cycle between 6 degrees and 88 degrees. This large range of motion rehabilitation regimen brings about much more flexion and extension than the configuration of FIGS. 35 and 36, and consequently more movement of the hip and knee articulations. Thus, the embodiment of FIGS. 37 and 38 may be preferred during a later stage of injury or post-surgery rehabilitation when the flexibility and strength of the affected joint, for example, a user's ACL or total knee arthroplasty (TKA) has increased.

Figure 39:
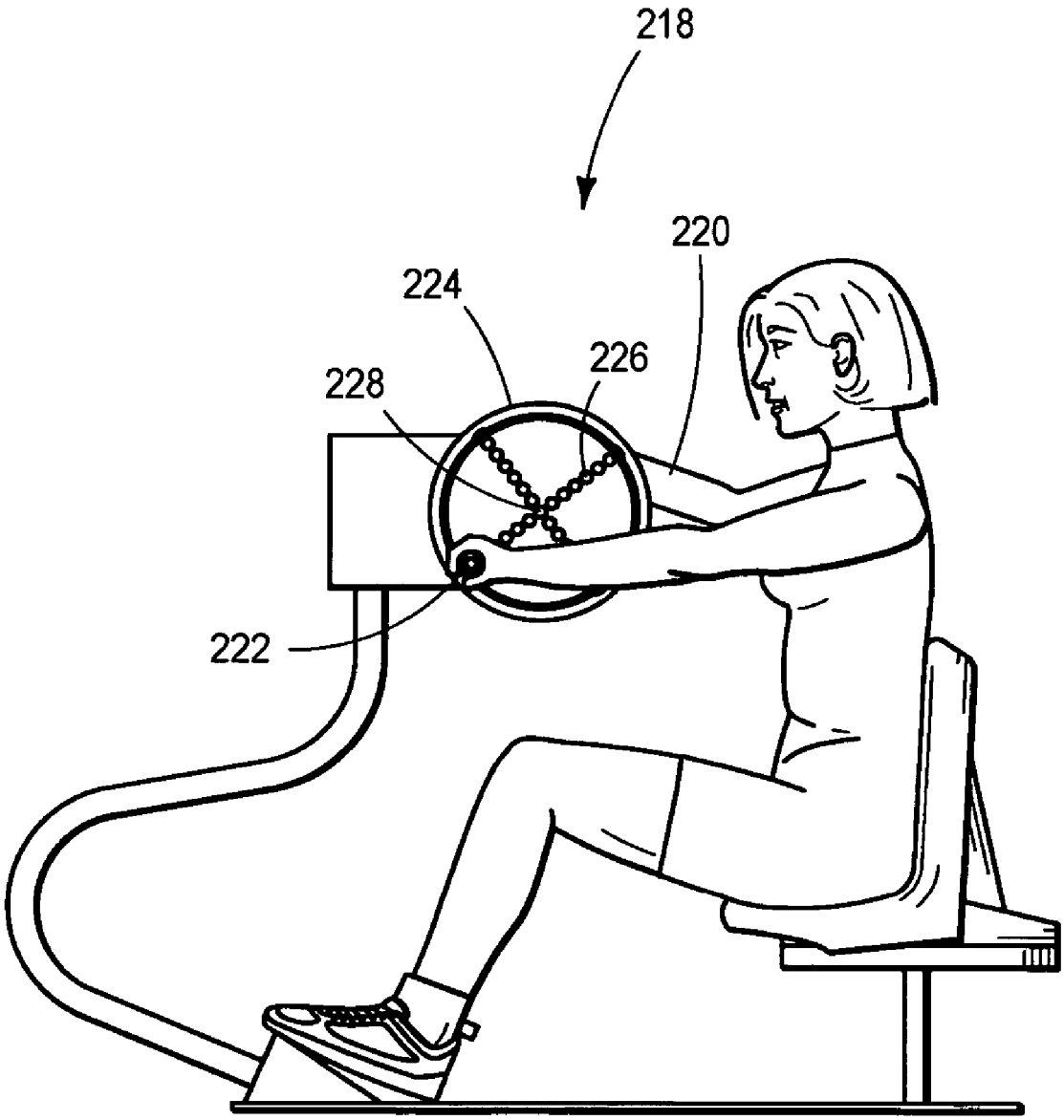
FIG. 39 is a right side elevation view of a rotary rehabilitation apparatus configured for upper extremity movement of the shoulder and/or elbow.
Figure 40:
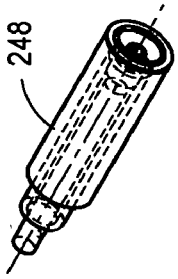
FIGS. 40-44 show various views (perspective view, exploded perspective view, right side elevation view, top plan view and front elevation view) of the lever assembly of a rotary rehabilitation apparatus of the present invention.
Figure 41:
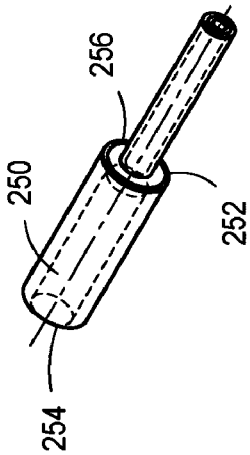
Figure 41:
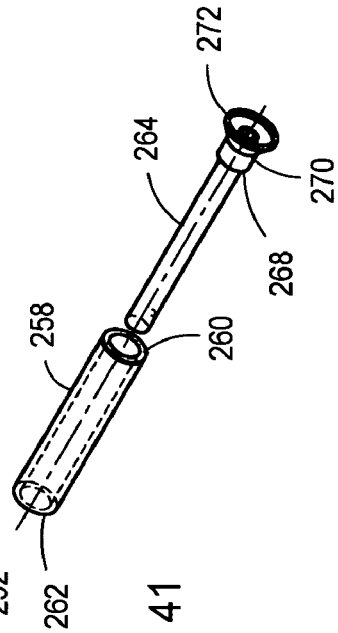
Figure 44:
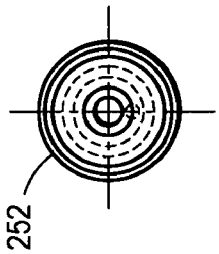
Figure 42:
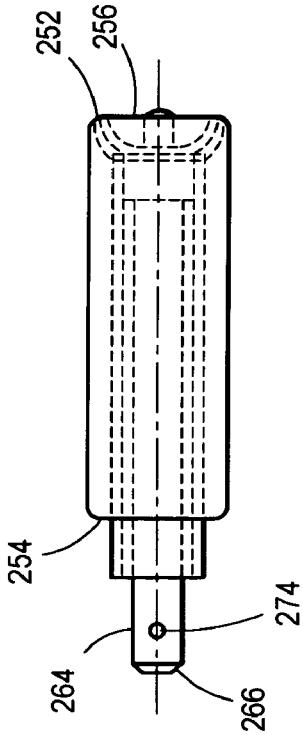
Figure 43:
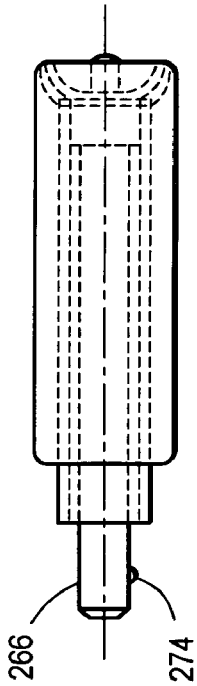

In the embodiment of the rotary rehabilitation apparatus 218 shown in FIG. 39, for upper extremities including the shoulder, wrist and elbow, the adjustable range of motion for each arm 220 is achieved by having the movable hand lever 222 be repositionable along one or more diameters of the flywheel 224. The flywheel 224 has a series of bores 226, either linear or non-linear as discussed above and depending upon the needs of the user's extremities, extending laterally there through parallel to the flywheel rotational axis and formed in a row along the flywheel diameter so that the hand lever 222 can be removably mounted with one of the bores 226. In the embodiment of the rotary rehabilitation apparatus 218 shown in FIG. 39, the flywheel 224 has two separate series of bores 226 each aligned along one flywheel diameter. As previously discussed and as shown in FIGS. 5-7 is an embodiment revealing a series of non-linearly arranged bores in the flywheel which is also contemplated by this invention.

Shown in FIGS. 40-44, is a fixed hand lever for use on the flywheel 224 seen in FIG. 39. The fixed hand lever is mounted to the flywheel 224 which is rotatably mounted at the center point 228. This configuration allows for lever adjustment both along the flywheel 224 diameter towards or away from the center point 228, and concentrically on the flywheel 224 around the center point 228 such that the hand lever 222 may be at an offset angle relative to the fixed hand lever about the flywheel axis of rotation of 30, 45 and 90 degrees or multiples thereof.

FIGS. 40-44 show the components of the movable hand lever 222. The hand lever body 248 may be tubular in shape or have other configurations that readily accommodate gripping by the human hand. The hand lever has a bore 250 extending through the body 248 from a lateral side face 252 to a medial side face 254. A chamfer 256 is also formed at the bore entrance of the lateral side face 252. A sleeve 258 has a first end 260 and a second end 262, and is configured for insertion into the bore 250 such that the second end 262 extends out of the lever medial side face 254. A pin 264 is inserted into the sleeve 258 and has a shank 266 extending out of second end 262 thereof, and a collar 268 having a concentric base 270 configured to abut the first end 260 and a beveled region 272 mateably fitting within the chamfer 256. A protrusion 274 is formed on the shank 266 near an end distal to the collar 268 such that the pin 264 frictionally fits within one bore 226 of the flywheel 224 to secure the hand lever body 248 thereto. If enough of a pulling force is applied to the hand lever body 248 away from the flywheel 224, the protrusion 274 is removed from the frictional fit in the bore 226 and may be repositioned as desired in another bore 226. The lever body 248 and sleeve 258 are also rotatable about the pin 264 such that as the flywheel 224 rotates, the lever body and sleeve also rotate such that the user can continue to apply a force thereto with their hands and arms through the rotary motion.

Similarly contemplated for the embodiment directed to the upper extremities is the use of the quick release adaptor 332 that is referenced above. In place of the bicycle pedal that is depicted in FIG. 18 would be a hand grip or other comparable device for gripping by the upper extremities.

Many alterations and modifications may be made by those having ordinary skill in the art without departing from the spirit and scope of the invention. Therefore, it must be expressly understood that the illustrated embodiment has been shown only for the purposes of example and should not be taken as limiting the invention which is defined by the following claims. The following claims are thus be read as not only literally including what is set forth by the claims but also to include all equivalent elements for performing substantially the same function in substantially the same way to obtain substantially the same result even though not identical in other respects to what is shown and described in the above illustration.

What is claimed is:

1. A method for selectively adjusting the range of articulation for the joint of a user's extremity engaged in a cycling action, comprising the steps of:

providing a seat whereon a user may sit;

providing a flywheel rotatably mounted to a support spaced from the seat, the flywheel configured for rotation about an axis, the flywheel having a first series of spaced-apart bores presenting a configuration from adjacent one portion of the perimeter wall of the flywheel to a diametrically opposed portion of the perimeter wall, the configuration of the series of bores extending through the center point of the flywheel;

providing a lever releasably mounted to one of the first series of spaced-apart bores and selectively re-positionable from one bore to another bore, the lever further comprising a bushing operably configured with a locking lever, the locking lever further comprising a push pad for securing the bushing against inadvertent release from the flywheel until pressure is applied to the push pad thereby unlocking the bushing from the bore, the lever extending outwardly from one of the substantially planar surfaces of the flywheel; and mounting the lever within one particular bore of the flywheel to select the desired articulating motion of the user's joints on the respective extremity of the user when the user's extremity is placed on the lever and a force is applied thereto.

2. The method of claim 1, wherein the configuration of spaced-apart bores is in a linear configuration from one portion of the perimeter wall extending through the center point of the flywheel to a diametrically opposed portion of the perimeter wall.

3. An apparatus providing an adjustable range of articulation motion for a joint corresponding to a user's extremity, comprising:

a flywheel comprising a circular plate having opposing substantially planar surfaces and a perimeter wall, the flywheel being rotatably mounted to a support for rotation about an axis, the flywheel having a first series of spaced-apart bores presenting a linear configuration from adjacent one portion of the perimeter wall of the flywheel to a diametrically opposed portion of the perimeter wall, the linear configuration of the series of bores extending through the center point of the flywheel;

a first lever releasably mounted to one of the first series of spaced-apart bores and selectively re-positionable from one bore to another bore, the first lever further comprising a bushing operably configured with a locking lever, the locking lever further comprising a push pad for securing the bushing against inadvertent release from the flywheel until pressure is applied to the push pad thereby unlocking the bushing from the bore, the first lever extending outwardly from one of the substantially planar surfaces of the flywheel; and a seat positioned at a distance from the flywheel such that a user seated on the seat may engage the first lever with an extremity and rotate the first lever, whereby re-positioning the first lever from one bore of the first series of bores to another bore of the first series of bores changes the path of motion for the user's extremity positioned on the first lever thereby altering the range of motion for the articulation of the user's joint associated with the corresponding extremity.

4. The apparatus of claim 3, further comprising a second series of spaced apart bores presenting a linear configuration from adjacent one portion of the perimeter wall of the flywheel to a diametrically opposed portion of the perimeter wall, the configuration of the second series of spaced apart bores bisecting the configuration of the first series of bores at substantially the center point of the flywheel.

5. The apparatus of claim 3, wherein the flywheel is rotatably mounted to a hub connected to the support, and further comprising:

a second lever secured to a crank extending outwardly from the flywheel hub such that a user may rotate the flywheel by imparting forces on the first lever and second lever with the user's extremities.

6. The apparatus of claim 3, wherein the flywheel further comprises means for increasing the inertia of the flywheel.

7. The apparatus of claim 6, wherein the means for increasing the inertia of the flywheel comprises:

a ring operably configured to receive the flywheel at the perimeter wall of the circular plate, the ring having an inner edge; and a brace member extending across one of the planar surfaces of the circular plate to span the inner diameter of the ring.

8. An apparatus providing an adjustable range of articulation motion for a joint corresponding to a user's extremity, comprising:

a flywheel comprising a circular plate having opposing substantially planar surfaces and a perimeter wall, the flywheel being rotatably mounted to a support for rotation about an axis, the flywheel having a first series of spaced-apart bores presenting a configuration from adjacent one portion of the perimeter wall of the flywheel to a diametrically opposed portion of the perimeter wall, the configuration of the series of bores extending through the center point of the flywheel;

a first lever releasably mounted to one of the first series of spaced-apart bores and selectively re-positionable from one bore to another bore, the first lever further comprising a bushing operably configured with a locking lever, the locking lever further comprising a push pad for securing the bushing against inadvertent release from the flywheel until pressure is applied to the push pad thereby unlocking the bushing from the bore, the first lever extending outwardly from one of the substantially planar surfaces of the flywheel; and a seat positioned at a distance from the flywheel such that a user seated on the seat may engage the first lever with an extremity and rotate the first lever, whereby re-positioning the first lever from one bore of the first series of bores to another bore of the first series of bores changes the path of motion for the user's extremity positioned on the first lever thereby altering the range of motion for the articulation of the user's joint for the corresponding extremity.

9. An apparatus providing an adjustable range of articulation motion for a joint corresponding to a user's extremity, comprising:

a flywheel comprising a circular plate having opposing substantially planar surfaces and a perimeter wall, the flywheel being rotatably mounted to a support for rotation about an axis, the flywheel having a first series of spaced-apart bores presenting a configuration from adjacent one portion of the perimeter wall of the flywheel to a diametrically opposed portion of the perimeter wall, the configuration of the series of bores extending through the center point of the flywheel;

a first lever comprising a slotted bushing operably configured with a pivotal locking lever, the locking lever further comprising a spring biased push pad, a center shaft and a locking pad disposed opposite the push pad; the slotted bushing detachably coupled to an assembly against which the user's extremity applies force, and wherein the slotted bushing is inserted through the bore thereby positioning a locking face of the locking pad against the opposing substantially planar surface of the flywheel securing the slotted bushing against inadvertent release from the flywheel until pressure is applied to the push pad thereby lowering the locking face to facilitate extraction of the slotted bushing from the bore, the first level being re-positionable from one bore to another bore; and a seat positioned at a distance from the flywheel such that a user seated on the seat may engage the first lever with an extremity and rotate the first lever, whereby re-positioning the first lever from one bore of the first series of bores to another bore of the first series of bores changes the path of motion for the user's extremity positioned on the first lever thereby altering the range of motion for the articulation of the user's joint for the corresponding extremity.

* * * * *